United States Patent [19]

Suris

[11] Patent Number: 5,074,824

[45] Date of Patent: Dec. 24, 1991

[54] COIN HOPPER

[75] Inventor: Vladimir Suris, Mayfield Hts., Ohio

[73] Assignee: Dixie-Narco, Inc., Ranson, W. Va.

[21] Appl. No.: 529,471

[22] Filed: May 29, 1990

[51] Int. Cl.[5] ..... G07D 1/00

[52] U.S. Cl. ..... 453/57; 221/203; 221/265

[58] Field of Search ..... 453/57, 49, 33, 32, 453/13; 221/203, 265, 237, 277, 182

[56] References Cited

U.S. PATENT DOCUMENTS

| | | | |
|---|---|---|---|
| 3,783,885 | 1/1974 | Williams et al. | 453/33 |
| 4,202,362 | 5/1980 | Kashio | 453/49 X |
| 4,407,312 | 10/1963 | Davila et al. | 453/33 X |
| 4,589,433 | 5/1986 | Abe | 453/57 |
| 4,798,558 | 1/1989 | Bellis | 453/57 X |
| 4,943,257 | 7/1990 | Nilsson et al. | 453/49 X |
| 5,017,176 | 5/1991 | Swierczek | 221/203 X |

FOREIGN PATENT DOCUMENTS

| | | | |
|---|---|---|---|
| 662597 | 5/1963 | Canada | 221/265 |
| 0080873 | 5/1984 | Japan | 453/57 |
| 1445089 | 8/1976 | United Kingdom | 453/33 |
| 2185341 | 7/1987 | United Kingdom | 453/57 |
| 2203582 | 10/1988 | United Kingdom | 453/33 |

*Primary Examiner*—David A. Bucci
*Assistant Examiner*—William M. Hienz
*Attorney, Agent, or Firm*—Renner, Kenner, Greive, Bobak, Taylor & Weber

[57] ABSTRACT

A bulk coin hopper and dispensing system is provided. A loading disc and a dispensing disc are fixedly secured to a motor driven shaft in spaced apart relationship to each other. A dispensing blade is interposed between the two discs. Bores in the loading disc are loaded with coins from a bulk hopper, the lower most coin in each of the bores resting upon the dispensing disc. As the discs rotate, the blade engages the coins thereon and urges them out of dispensing slots within the dispensing disc. Ball plungers are provided to restrict movement of the coins upon the dispensing disc until contacted by the blade.

19 Claims, 2 Drawing Sheets

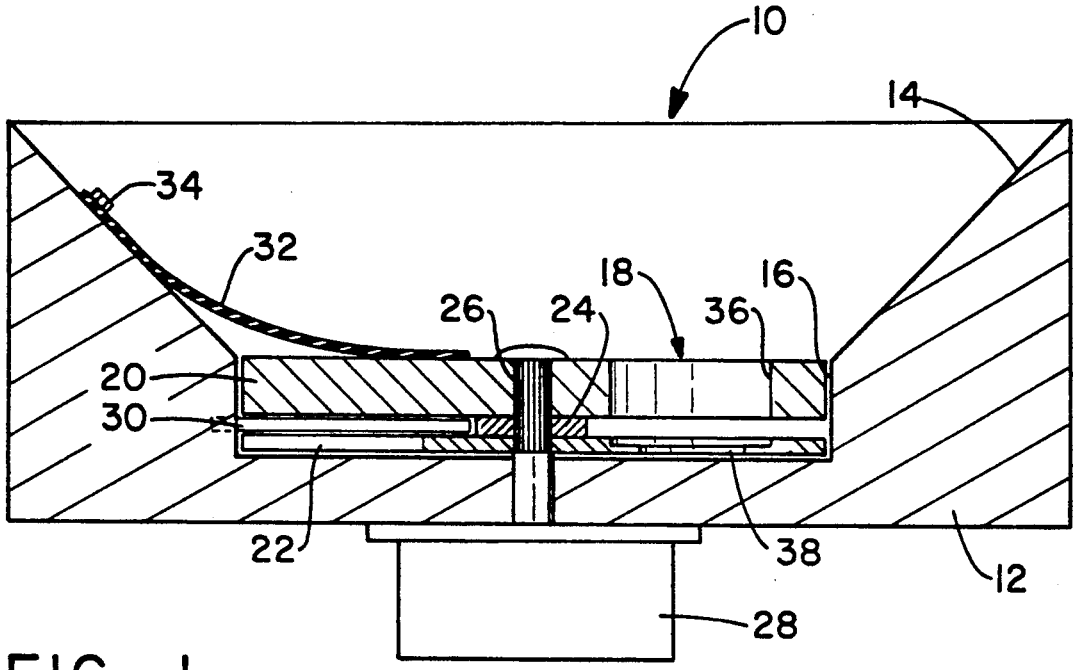
FIG.-1
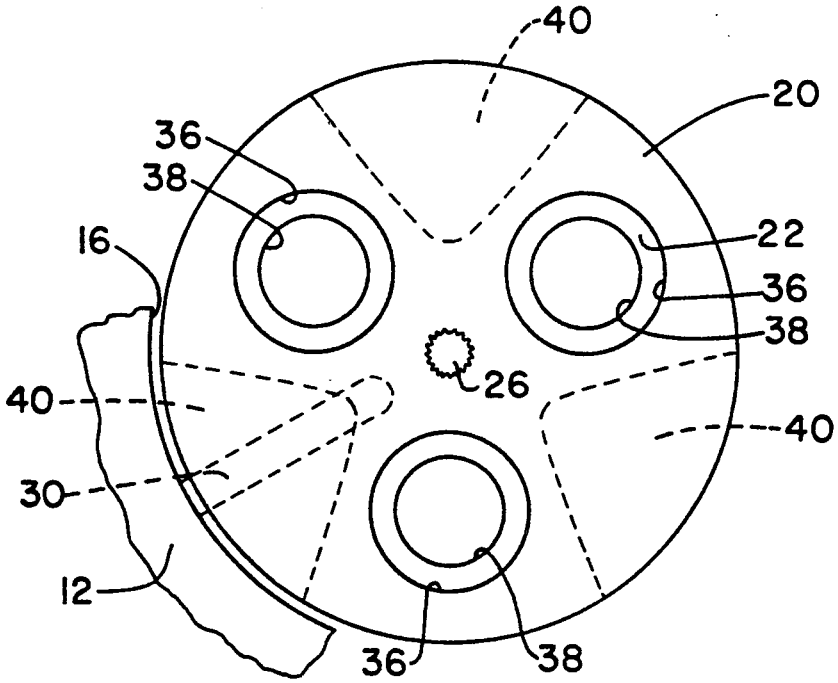
FIG.-2
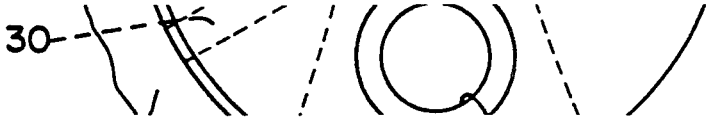

COIN HOPPER

TECHNICAL FIELD

The invention herein resides in the art of currency validators and changers. More particularly, the invention relates to a bulk coin hopper in which a bulk supply of coins is received within a hopper and singularly dispensed therefrom.

BACKGROUND ART

It is well known that currency validators and changers typically require a supply of coins and a dispensing system for dispensing a number of coins in response to receipt of authentic pieces of currency. For the most efficient use of physical space and operator time, bulk hoppers and dispensing systems are typically employed. In such systems, a chamber is filled with a bulk supply of coins of a single denomination or value and a dispensing system is provided for dispensing the coins therefrom, one at a time. Presently known systems include those employing two or more discs, typically rotating at different speeds, to separate a volume of coins from the bulk supply, and then to separate the coins from each other for singular dispensing.

The prior art bulk coin dispensers have typically been given to coin jams between the discs and/or plates of the systems. While reversing the rotation of the dispensing member has generally been provided as a means for overcoming such jams, certain systems show a tendency to aggravate the jam by such reversal.

The existing state of the art of bulk coin hoppers has also experienced manufacturing problems, in which various discs and/or plates of the systems are required to operate in close precision with each other, requiring that such elements be manufactured to tight tolerances and not be given to distortion, buckling, twisting or the like. Additionally, presently existing systems have typically required a substantial number of parts, particularly discs and plates, which must be precisely assembled and aligned with each other to achieve the desired operational features. Additionally, the present systems of the bulk coin hopper type have been plagued with wear problems which reduce the efficiency and accuracy of operation, increasing the susceptibility of the systems to jams and failure.

It has previously been known that many of the existing systems have been given to jams when foreign materials are introduced therein. Since bulk hoppers are employed for purposes of minimizing the time required by the attendant for refilling the hopper and removing currency, such operators are typically not inclined to check the hopper for foreign material which might be introduced therein. Accordingly, elements which may find their way into the hopper and which have a physical configuration significantly different from that of a coin may jam the various moving parts of the dispensing system which are uniquely adapted for separating the coins from each other and singularly dispensing the same.

Finally, certain of the present systems require a somewhat complex arrangement of spring mechanisms for deflecting and/or temporarily engaging and retaining coins during the dispensing operation.

DISCLOSURE OF INVENTION

In light of the foregoing, it is a first aspect of the invention to provide a bulk coin hopper in which jams are substantially eliminated.

Another aspect of the invention is to provide a bulk coin hopper in which manufacturing problems incident to dimensional and tolerance restrictions are substantially reduced.

Still a further aspect of the invention is the provision of a bulk coin hopper which is easily assembled due to substantial reductions in precision and alignment requirements.

Yet an additional aspect of the invention is the provision of a bulk coin hopper in which wear problems are significantly reduced from the prior art.

Still a further aspect of the invention is the provision of a bulk coin hopper which provides means for expelling foreign materials received therein.

Still an additional aspect of the invention is the provision of a bulk coin hopper which obviates the necessity of springs of various natures for deflecting and/or temporarily receiving and retaining coins during the dispensing operation.

Yet a further aspect of the invention is the provision of a bulk coin hopper which is durable and reliable in operation, while being simplistic and economic to construct with state of the art materials.

The foregoing and other aspects of the invention which will become apparent as the detailed description proceeds are achieved by a coin hopper and dispenser, comprising: a receptacle for a bulk supply of coins; a first member received at a bottom portion of said receptacle, said first member having at least one bore passing therethrough for receiving a plurality of stacked coins therein; a second member beneath said first member in fixed spaced apart relationship therewith, said second member having at least one passage therethrough for receiving and passing coins from said bore; and a third member interposed between said first and second members for urging coins from said bore to said passage.

Yet further aspects of the invention are attained by a coin dispensing system, comprising: a trough for receiving a bulk supply of coins; a first disc received at a bottom of said trough; a second disc received at said bottom of said trough and beneath said first disc, said first second discs being spaced apart a distance greater than a thickness of one of said coins and less than twice said thickness; and a stationary blade interposed between said first and second discs.

DESCRIPTION OF DRAWINGS

For a complete understanding of the objects, techniques and structure of the invention, reference should be made to the following detailed description and accompanying drawing wherein:

FIG. 1 is a partial sectional view of an embodiment of a bulk coin hopper and dispenser according to the invention;

FIG. 2 is a partial sectional top plan view of the structure of FIG. 1, showing the relationship of the dispensing discs thereof;

BEST MODE FOR CARRYING OUT THE INVENTION

Figure 3:
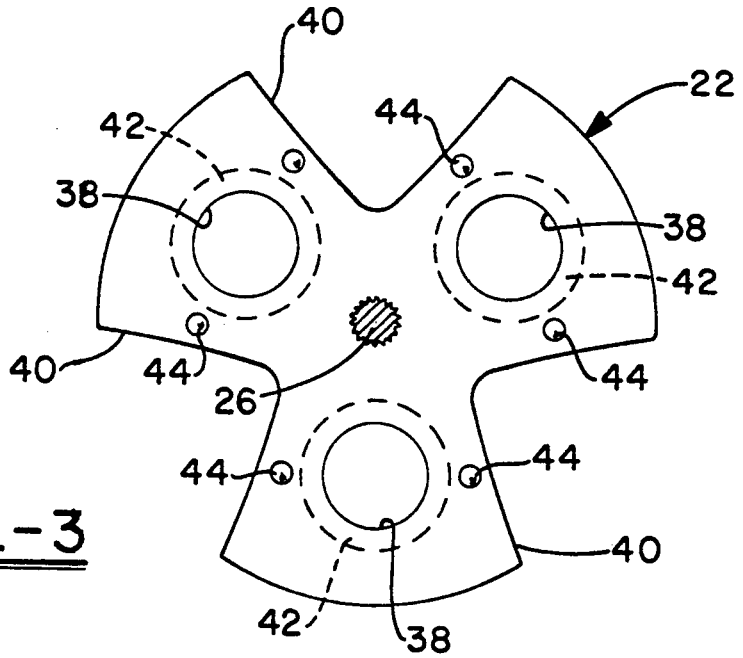
FIG. 3 is a top plan view of the dispensing disc of the invention.

Referring now to the drawings and more particularly FIG. 1, it can be seen that a coin hopper and dispenser according to the invention is designated generally by the numeral 10. A housing 12 of metallic or other suitable construction is formed to define a conical bowl or trough to serve as a hopper for the bulk receipt of coins. The conical bowl 14 is truncated at the bottom thereof where a cylindrical bore 16 is provided within the housing 12.

The bore 16 is adapted to receive a dispenser assembly 18 comprising a loading disc 20 and a dispensing disc 22, the two discs being spaced apart by means of an appropriate spacer 24. The discs 20, 22 are keyed or otherwise secured to a shaft 26 which is driven by a motor 28 which, in the preferred embodiment of the invention, is a reversible motor, adapted for clockwise and counterclockwise rotation. It will be appreciated that the discs 20, 22 are appropriately keyed to the shaft 26 to be adapted for unitary rotation therewith such that the alignment of the discs 20, 22 remains constant.

A blade 30 extends inwardly from the sidewall of the cylindrical bore 16 into the space between the discs 20, 22. The blade 30 assists in the dispensing of coins in a manner to be discussed later herein. A flexible mat 32 is affixed as at 34 to the sloping sidewall of the conical bowl 14 in the manner shown. The mat 32 is preferably of a cord reinforced elastomeric material which is triangular in shape, the apex of the mat 32 extending downwardly and onto the top surface of the loading disc 20, stopping short of the shaft 26. The mat 32 serves to agitate the coins within the conical bore 14 and atop the loading disc 20, urging the coins into receptacles within the disc 20 in a manner to be discussed later.

As shown in FIG. 2 the loading disc 20 is characterized by a plurality of bores 36 passing therethrough. The bores 36 have a diameter greater than the diameter of the coins to be received therein, but less than 1.4 times such diameter. The bores 36 have centers lying equal distance from the center line of the rotational axis defined by the shaft 26, and are equally spaced thereabout. In the embodiment shown, in which three such bores are provided, the bores would be spaced 120° apart.

Bores 38 are provided in the dispensing disc 22 and in substantial alignment with the associated bores 36 of the loading disc 20. Accordingly, the bores 38 have centers lying equal distance from the centerline of the rotational shaft 26 and spaced equally thereabout. As shown, the diameters of the bores 38 are less than the diameters of the bores 36 and less than the diameter of the coins to be received within the hopper 14. In the preferred embodiment of the invention, the bores 38 have a diameter less than 0.7 times the diameter of the coins.

With continued reference to FIG. 2, it can be seen that the dispensing disc 22 is provided with a plurality of payout slots 40 therein. The slots 40 may take any of various geometric shapes, but in the embodiments shown they are preferably of a triangular shape interposed between the bores 38 and the projection of the bores 36 upon the dispensing disc 22, with such projections being made parallel to the shaft 26. In other words, it is preferred that there be no overlap between the bores 36 and the payout slots 40, it being required that the slots 40 have areas therein sufficient to allow the free passage of coins therethrough in a manner which will become apparent herein.

As further shown in FIG. 2, the blade 30 comprises an elongated stationary member extending from the sidewall of the cylindrical bore 16 defined by the housing 12. The blade 30 preferably extends radially inwardly toward the center of the shaft 26.

With reference now to FIG. 3, it can be seen that the dispensing disc 22 has coin receiving areas 42 thereon, such coin receiving areas being shown in the drawing wherein the dashed lines and encompassing respective bores 38. It will be appreciated that the loading disc 20 has a thickness of 4–6 times the thickness of the coins to be received within the hopper 14, such that each of the bores 36 will receive therein 4–6 of such coins. It will also be appreciated that the loading disc 20 and the dispensing disc 22 are separated from each other by a space which is greater than the thickness of one of such coins, but less tan twice such thickness, such that as the bores 36 are loaded with coins, the lower most coin in each of the bores is received upon the dispensing disc 22 in the associated coin receiving area 42. To prevent the coins received within the areas 42 from "walking" or otherwise making undesired shifts or movements upon the disc 22, ball plungers 44 are placed in diametric opposition across the areas 42 as shown. The ball plungers 44 serve as retaining means for the coins received upon the disc 22. Accordingly, the coins are maintained in the coin receiving areas 42 until rotation of the shaft 26 causes the coins to engage the blade 30 and to be urged through the passages of the payout slots 40 to then drop the motor 28 to a coin dispensing chute or the like.

Figure 4:
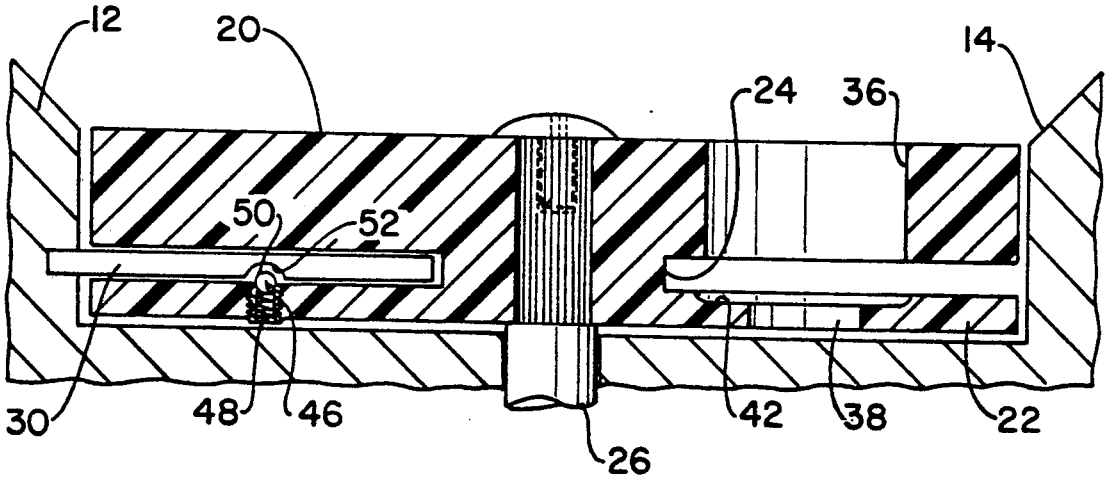
FIG. 4 is a cross sectional view of an embodiment of the invention showing the relationship of the loading disc, dispensing disc, and blade thereof.

As shown in FIG. 4, each of the ball plungers 44 comprises a threaded body 46 which is screwed into the dispensing disc 22. A spring 48 is received within the threaded body 46 and urges a ball 50 through a restricted opening in the end thereof. As will be appreciated by those skilled in the art, the opening in the end of the threaded body 46 has a smaller diameter than hat of the ball 50 such that only a portion of the ball 50 extends therefrom. In a preferred embodiment of the invention, and as shown in FIG. 4, the blade 30 has a notch or cut-out area 52 at a point which will allow the ball plungers 44 to pass therethrough without contacting the blade 30. Accordingly, it will be appreciated that each of the ball plungers 44 lies in a locus of points equal distance from the center of the shaft 26, defining a circle thereabout.

As further shown in FIG. 4, the loading disc 20 and payout disc 22, as well as the spacer 24 may be formed from a single piece of material such as plastic or the like. In such a configuration, the construction of the elements 20–24 would be on the order of a spool, with the spacer portion 24 again being greater than the thickness of the coins to be handled, but less than twice the thickness thereof. By being greater than the typical thickness of the coins, bent coins can be received and passed. With the spacer 24 being less than twice the thickness of the coins, it is assured that dual coins will not be dispensed and jams will be eliminated.

With an appreciation of the structure of the invention, the operation thereof can now be understood. The hopper 14 is filled with coins of a single size and denomination. The motor 28 is caused to rotate, such rotation causing the bores 36 to fill with a stack of coins under the urging of the cord reinforced mat 32. The bottom coin in each of the bores 36 is received in the are 42 of the dispensing disc 22 and is restrained thereat by the ball plungers 44. As the motor 28 causes the shaft 26 to rotate, the coins in the areas 42 come into contact with the elongated blade 30 which urges the coins to deflect the bal 50 of the ball plungers 44 and to pass through the payout slots or passages 40 of the disc 22. The coins so passed are received in a payout chute or the like with such chute including appropriate means for counting the dispensing of coins to guarantee that the proper dispensing occurs. When the proper number of coins have been dispensed, rotation of the motor 28 ceases. As the coin is moved from the area 42 to the slot 40, the stack of coins within the bore 36 drops so that the next coin is received in the are 42. At the same time, the mat 32 urges another coin into the bore 36 at the top of the stack.

Should any foreign material be received within the hopper 14, it will readily be appreciated that it may pass into one of the bores 36. However, such foreign material such as a nut, bolt, or the like, will pass directly through the bore 36 of the loading disc 20 and out of the dispensing system by virtue of the aligned bore 38 of the dispensing disc 22. Accordingly, the dispensing system of the invention is self-purging of foreign and unwanted materials.

It will also be appreciated that the notch 52 within the blade 30 prevents unnecessary wear on both the blade 30 and the ball plungers 44, allowing the plungers 44 to be deflected only by the movement of a coin thereover toward the oncoming payout slot 40 of the rotating disc 22.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A coin hopper and dispenser, comprising:

a receptacle for a bulk supply of coins;

a first member received at a bottom portion of said receptacle, said first member having at least one bore passing therethrough for receiving a plurality of stacked coins therein;

a second member beneath said first member in fixed spaced apart relationship therewith, said second member having at least one passage therethrough for receiving and passing coins from said bore; and a stationary third member interposed between said first and second members for urging coins passing from said bore to said passage wherein a single coin drops from said bore to said second member, said single coin and said first and second members rotate in unison about an axis, and said stationary third member then engages said single coin and urges it from said second member into said passage as said first and second members rotate, to cause said coin to drop through said second member.

2. The coin hopper and dispenser according to claim 1, wherein said first and second members are rotatable about a common axis in fixed relation to each other.

3. The coin hopper and dispenser according to claim 2, wherein said third ember is a stationary elongated member.

4. The coin hopper and dispenser according to claim 3, wherein said first and second members comprise first and second discs, said first and second discs being spaced apart a distance greater than the thickness of one of said coins and less than twice said thickness.

5. The coin hopper and dispenser according to claim 4, wherein said at least one bore of said first disc does not overlap, in a direction parallel to said axis, said at least one passage of said second disc.

6. The coin hopper and dispenser according to claim 5, further comprising retaining means extending between said first and second discs and in association with said at least one bore for retaining a coin in substantial alignment with said bore and upon said second disc until contacted by said stationary elongated member.

7. The coin hopper and dispenser according to claim 6, wherein said retaining means comprise deflectable members, spaced apart about a circumference of said coin retained in said substantial alignment with said at least one bore.

8. The coin hopper and dispenser according to claim 7, wherein said stationary member is contoured to allow said deflectable members to pass beneath said stationary member without contacting said stationary members as said discs rotate about said axis.

9. The coin hopper and dispenser according to claim 5, wherein said second disc has a second passage therethrough in substantial alignment with said at least one bore of said first disc, said second passage being dimensioned to prevent passage of said coins therethrough.

10. A coin dispensing system, comprising:

a trough for receiving a bulk supply of coins;

a first disc received at a bottom of said trough;

a second disc received at said bottom of said trough and beneath said first disc, said first and second discs being spaced apart a distance greater than a thickness of one of said coins and less than twice said thickness;

a stationary blade interposed between said first and second discs;

wherein said first disc has a plurality of bores therethrough adapted for receiving a stack of said coins, and said second disc has a plurality of passages therein adapted for singularly receiving coins from said bore and passing said coins through said second disc; and wherein single coins drop from said bores to said second disc, said single coins and said discs rotate in unison about an axis, and said stationary blade then engages individual ones of said single coins and urges them individually from said second disc into respective ones of said passages as said discs rotate, to cause said coins to drop through said second disc.

11. The coin dispensing apparatus according to claim 10, wherein said discs are fixed to a common shaft and rotatable thereabout in unison.

12. The coin dispensing apparatus according to claim 11, wherein said bores and said passages are axially displaced from each other with respect to said common shaft.

13. The coin dispensing apparatus according to claim 12, wherein said passages extend into a circumferential edge of said second disc.

14. The coin dispensing apparatus according to claim 11, wherein said second disc has a plurality of bores passing therethrough, said bores of said second disc being of smaller diameter than said bores of said first disc and said bores of said second disc being in substantially axial alignment with said bores of said first disc.

15. The coin dispensing apparatus according to claim 11, further comprising retaining means associated with each of said bores for retaining a coin upon said second disc in substantial alignment with an associated bore.

16. The coin dispensing apparatus according to claim 15, wherein each said retaining means comprises a deflectable member.

17. The coin dispensing apparatus according to claim 16, wherein said stationary blade is configured to pass said deflectable members of said retaining means without contact upon rotation of said discs upon said shaft.

18. The coin dispensing apparatus according to claim 17, wherein said deflectable members comprise spring loaded ball plungers.

19. The coin dispensing apparatus according to claim 15, further comprising a flexible mat received within said trough and atop said first disc for urging coins into said bores.

* * * * *